US006211756B1

(12) United States Patent
Sun et al.

(10) Patent No.: US 6,211,756 B1
(45) Date of Patent: Apr. 3, 2001

(54) ELECTROMECHANICAL RELAY AND METHOD OF MATCHING THE IMPEDANCE OF THE RELAY WITH THE IMPEDANCE OF A SIGNAL SOURCE

(75) Inventors: Richard L. Sun, Redwood City; Given Chun, Torrance; Ricardo E. Vallero, Yorba Linda, all of CA (US)

(73) Assignee: Teledydne Industries, Inc., Los Angeles, CA (US)

( * ) Notice: Subject to any disclaimer, the term of this patent is extended or adjusted under 35 U.S.C. 154(b) by 0 days.

(21) Appl. No.: 09/187,993

(22) Filed: Nov. 6, 1998

(51) Int. Cl.[7] ..... H01H 53/00
(52) U.S. Cl. ..... 335/4; 335/78; 335/83
(58) Field of Search ..... 335/4, 5, 78–86; 333/101, 105–108

(56) References Cited

U.S. PATENT DOCUMENTS

| | | | | |
|---|---|---|---|---|
| 3,681,719 | * | 8/1972 | Treschitta | 335/5 |
| 3,694,777 | | 9/1972 | Muller | 335/128 |
| 4,081,772 | | 3/1978 | Schuessler et al. | 335/200 |
| 4,101,855 | | 7/1978 | Drapeau | 335/106 |
| 4,496,919 | | 1/1985 | Fournier | 335/5 |
| 5,025,237 | * | 6/1991 | Yamazaki et al. | 335/383 |
| 5,815,057 | * | 9/1998 | Hoffman et al. | 335/4 |

OTHER PUBLICATIONS

Teledyne Relays Series RF310, RF 313 Brochure, 1997.
Teledyne Relays Series RF320, RF 323 Brochure, 1997.
Teledyne Relays Series RF300, RF 303 Brochure, 1994.

* cited by examiner

*Primary Examiner*—Ray Barrera
(74) *Attorney, Agent, or Firm*—Kirkpatrick & Lockhart LLP

(57) ABSTRACT

An electromechanical relay (10) that includes a frame (52) and a header assembly (20) having a plurality of contacts (24, 26, 28). The relay (10) also includes a core assembly (62) having an end engaging the frame (52). The relay (10) further includes an armature assembly (64) pivotally connected to the core assembly (62). The armature assembly (64) has at least one actuator (76, 77) engaging one of the contacts (24, 26). The relay (10) also includes a shield (16) connected to the header assembly (20) and defining a cavity (84) in which the contacts (24, 26, 28) are disposed.

25 Claims, 9 Drawing Sheets

ELECTROMECHANICAL RELAY AND METHOD OF MATCHING THE IMPEDANCE OF THE RELAY WITH THE IMPEDANCE OF A SIGNAL SOURCE

BACKGROUND OF THE INVENTION

1. Field of the Invention

The present invention is directed generally to an electromechanical relay and, more particularly, to an ultraminiature electromechanical relay.

2. Description of Background

Ultraminature electromechanical relays are used in various applications, such as instrumentation, telecommunications, automatic test systems, wireless technologies, automotive and medical electronics, as well as commercial and general aviation and aerospace applications. Many of these applications, and others, operate in very high frequency ranges, such as 100 MHz to 10 GHz, and even beyond. General purpose ultraminiature electromechanical relays are typically not designed to handle such high frequencies. They are typically limited to applications below 4 GHz. Above this range, the signal fidelity of prior relays is typically diminished.

Accordingly, there exists a need for an electromechanical relay which can operate in the frequency ranges demanded by many high frequency applications without diminishing signal fidelity.

BRIEF SUMMARY OF INVENTION

The present invention is directed to an electromechanical relay. The relay includes a frame and a header assembly having a plurality of contacts. The relay also includes a core assembly having an end engaging the frame. The relay further includes an armature assembly pivotally connected to the core assembly. The armature assembly has an armature and at least one actuator engaging one of the contacts. The relay also includes a shield connected to the header assembly which defines a cavity in which the contacts are disposed. The contacts are disposed in the cavity of the shield.

The present invention represents a substantial advance over prior art relays. The present invention has the advantage that it is operable at very high frequencies without diminishing signal fidelity. The present invention also has the advantage that it prevents leakage and radiation of high frequency signals transmitting through the relay.

BRIEF DESCRIPTION OF THE SEVERAL VIEWS OF THE DRAWINGS

For the present invention to be clearly understood and readily practiced, the present invention will be described in conjunction with the following figures, wherein.

DETAILED DESCRIPTION OF THE INVENTION

Figure 1:
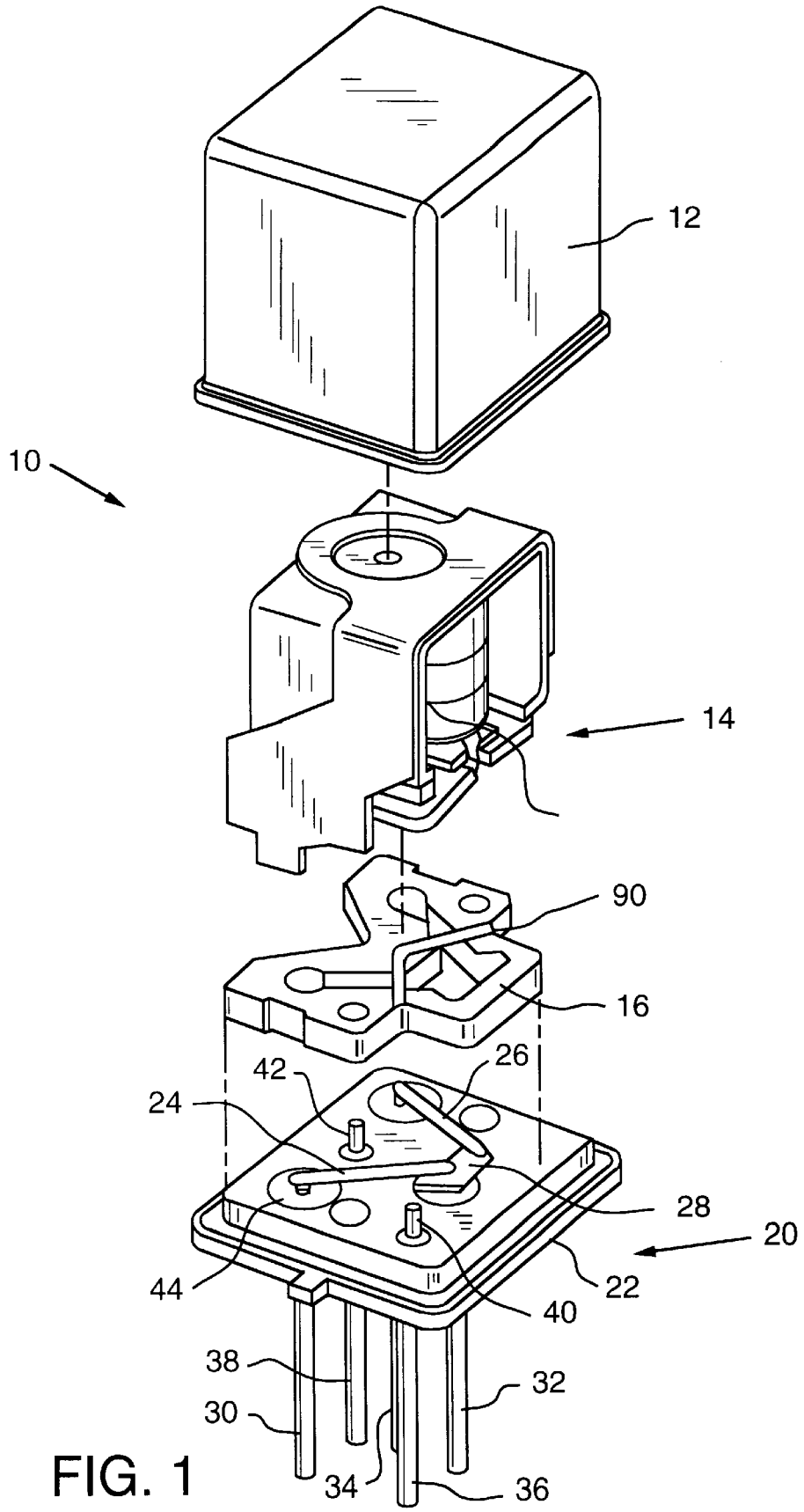
FIG. 1 is a diagram illustrating an exploded view of a relay according to the present invention.

FIG. 1 is a diagram illustrating an exploded view of a relay 10 according to the present invention. The relay 10 includes a cover 12, a motor assembly 14, a shield 16, and a header assembly 20. The cover 12 may be constructed of any material which protects the relay 10 from electromagnetic interference such as, for example, metal.

The header assembly 20 includes a header blank 22. The header blank 22 may be constructed of a conductive material such as, for example, a gold-plated alloyed metal sold under the trade name Kovar®, a registered trademark of Westinghouse Electric & Manufacturing Co., aluminum, steel, copper, nickel, and other metal alloys. The header blank 22 may be connected to electrical ground. In the embodiment of the relay 10 illustrated in FIG. 1, the header assembly 20 includes a normally open (NO) moving contact 24, a normally closed (NC) moving contact 26, and a lower stationary contact 28 mounted to a top side of the header blank 22. The contacts 24, 26, 28 may be constructed of any material which ensures reliable switching such as, for example, a gold-plated precious metal alloy.

The header assembly 20 also includes three signal terminals 30, 32, 34. The normally open moving contact 24 is connected at one end to the signal terminal 30; the NC moving contact 26 is connected at one end to the signal terminal 34; and the lower stationary contact 28 is connected to signal terminal 32. The moving contacts 24, 26 may have a preset load, such as by a mechanical spring action, forcing the end of the moving contacts 24, 26 not connected to the signal terminals 32, 34 away from the header blank 22 and toward the motor assembly 14. The header assembly 20 also includes two voltage terminals 36, 38 and two lead posts 40, 42. The lead posts 40, 42 are portions of the voltage terminals 36, 38, respectively, which extend through the header blank 22. The connections between the contacts 24, 26, 28 and the signal terminals 30, 34, 32 are electrically insulated from the header blank 22 by seals 44, as are the connections between the lead posts 40, 42 and the voltage terminals 36, 38. The seals 44 may be made from an insulative material such as, for example, glass.

The embodiment illustrated in FIG. 1 is utilized in a single pole/double throw (SPDT) relay 10. In another embodiment of the present invention, a different number of contacts 24, 26, 28 may be employed, such as two pairs of moving contacts 24, 26 and a pair of upper stationary contacts 28, with a concomitant number of signal terminals 30, 32, 34. This would correspond to a double pole/double throw (DPDT) relay. A different number of voltage terminals 36, 38 may also be used.

Figure 2:
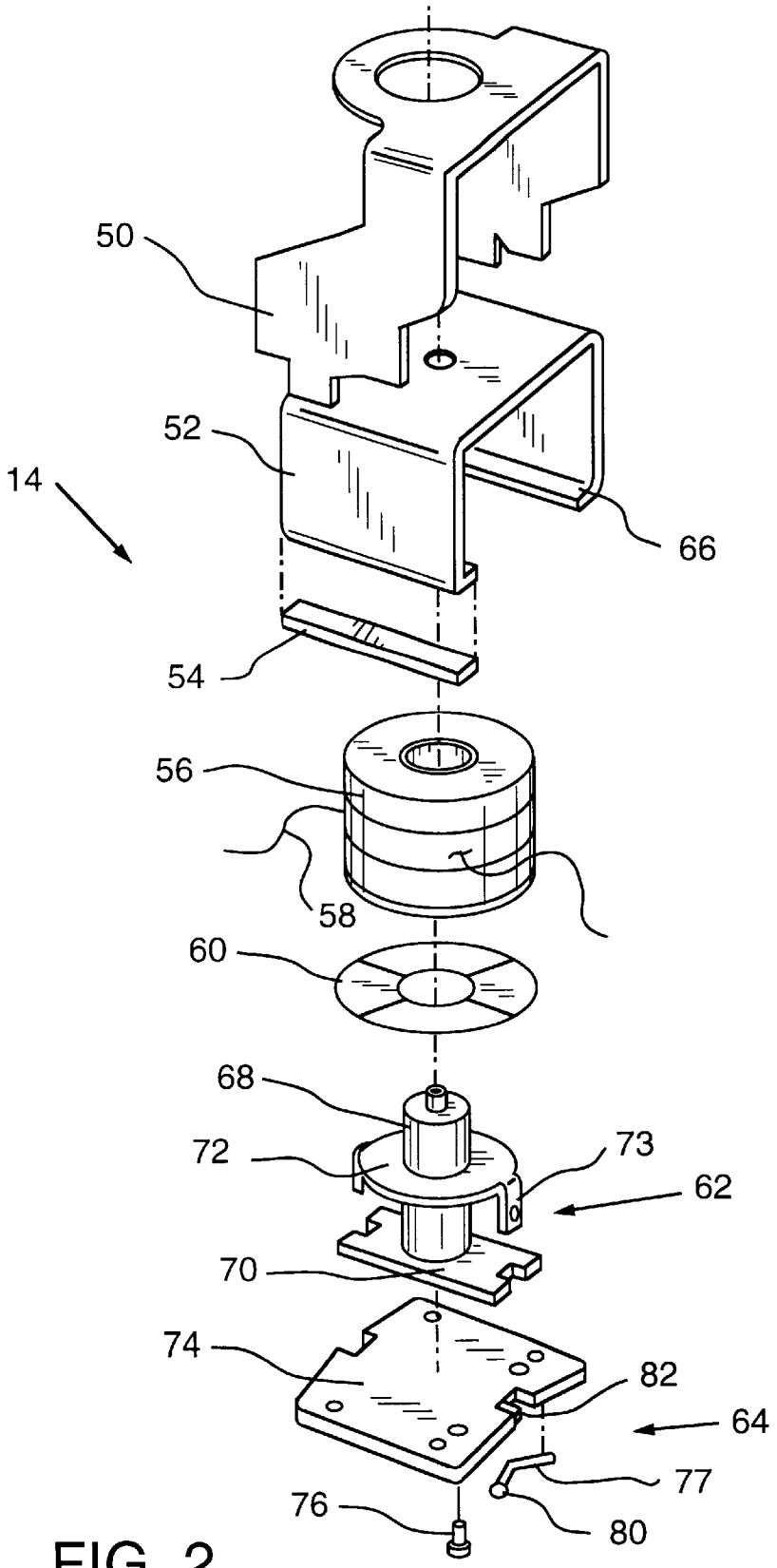
FIG. 2 is a diagram illustrating an exploded view of a motor assembly of the relay of FIG. 1.

FIG. 2 is a diagram illustrating an exploded view of the motor assembly 14 of the relay 10 of FIG. 1. The motor assembly 14 includes a mounting bracket 50, a frame 52 with a permanent magnet 54, a coil 56 with coil leads 58, a spring washer 60, a core assembly 62, and an armature assembly 64. The mounting bracket 50 and the frame 52 may be constructed of a material which provides high magnetic efficiency and mechanical rigidity to the relay 10 such as, for example, metal. The frame 52 includes opposing depending ends, one of which may be connected to the permanent magnet 54 and the other may define a pole face 66. The core assembly 62 includes a core shank 68, a core head 70, and a clip pivot 72. The clip pivot 72 may include a pair of opposed depending legs 73. The armature assembly 64 includes an armature 74 and a number of actuators 76, 77. In the illustrated embodiment, the armature 74 is bent at substantially the center of the armature 74 at an obtuse angle. Other embodiments of the present invention contemplate the use of differently shaped armatures 74. The actuators 76, 77 have heads 80 made of an insulative material such as, for example, glass. In the embodiment of the motor assembly 14 illustrated in FIG. 2, the armature 74 has two actuators 76, 77, although a different number of actuators 76, 77 may be utilized. The armature 74 also includes a hinge pin 82 to connect the armature 74 to the core assembly 62, as described hereinbelow.

To complete the description of the motor assembly 14, the core shank 68 is mounted to the core head 70. The clip pivot 72, the spring washer 60, the coil 56, the frame 52, and the mounting bracket 50 all have openings for receiving the core shank 68. The depending legs 73 of the clip pivot 72 extend away from the core shank 68 and toward the armature assembly 64. The hinge pin 82 of the armature 74 is pivotally connected to the depending legs 73 of the clip pivot 72 such that the armature 74 is capable of rotational movement relative to the core assembly 62. Other embodiments of the present invention contemplate different manners in which to pivotally connect the armature 74. The cover 12 may be hermetically sealed to the header blank 22 of the header assembly 20. In addition, the coil leads 58 of the coil 56 are connected to the lead posts 40, 42. The shield 16 is mounted to the header blank 22, as described hereinbelow.

Figure 3:
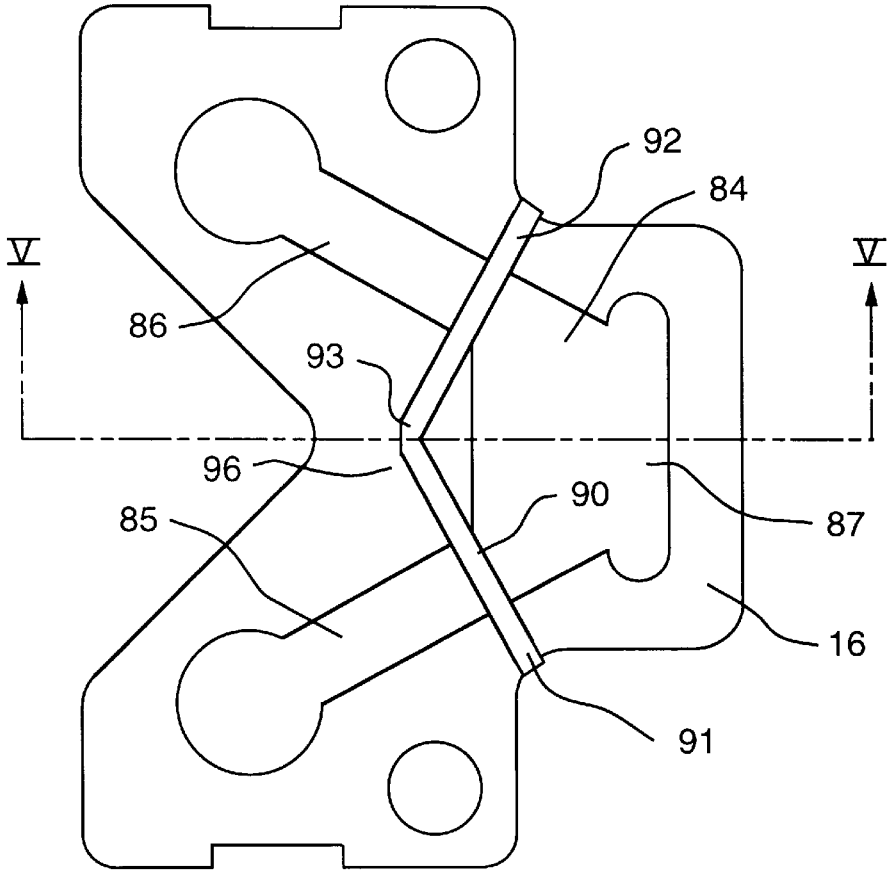
FIG. 3 is a diagram illustrating a top-view of the shield of the relay of FIG. 1.
Figure 4:
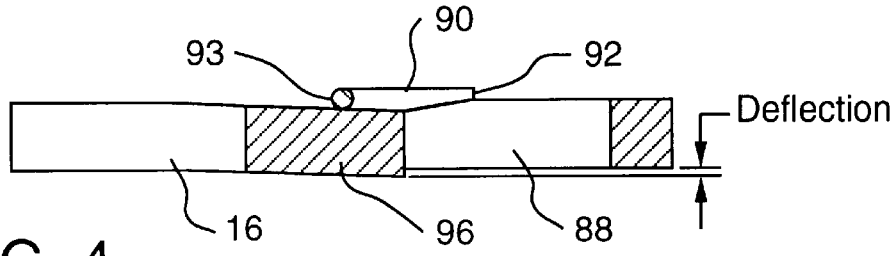
FIG. 4 is a diagram illustrating a cross-sectional side-view of the shield of the relay of FIG. 1.

FIGS. 3 and 4 are diagrams illustrating the shield 16 of the relay 10 of FIG. 1. FIG. 3 is a top-view of the shield 16 and FIG. 4 is a cross-sectional side-view of the shield 16. The shield 16 may be constructed from a conductive material, such as, for example, a Kovar® metal alloy with gold plating, aluminum, steel, copper, nickel, and other metal alloys. The shield 16 defines a substantially V-shaped cavity 84 with side walls 88, and is connected to the header blank 22 such that the moving contacts 24, 26 and the lower stationary contact 28 are disposed in the cavity 84. The moving contacts 24, 26 are disposed respectively in the channels 85, 86 of the cavity 84, and the lower stationary contact 28 is disposed in the vertex channel 87 of the cavity 84. In other embodiments of the present invention, the cavity 84 and the shield 16 may be shaped differently in order that various configurations of contacts 24, 26, 28 may be disposed in the cavity 84. The cavity 84 is precisely sized, as described hereinbelow with reference to FIGS. 9–10, to provide impedance matching for the relay 10 for transmitting and receiving high frequency signals.

The shield also includes an upper stationary contact 90, which may be constructed of a conductive material, such as metal. The upper stationary contact 90 may be substantially V-shaped, and is connected to a top-side of the shield 16 such that each end 91, 92 of the upper stationary contact 90 is adjacent one channel 85, 86 of the cavity 84. The vertex portion 93 of the upper stationary contact 90 may be connected to a center portion 96 of the shield 16. The upper stationary contact 90 may be connected to the shield 16 in various manners, such as, for example, by resistance welding, laser welding, and epoxy bonding. In other embodiments of the present invention, the upper stationary contact 90 may assume different geometrical shapes, particularly if a differently shaped cavity 84 is provided in the shield 16. In addition, in other embodiments of the present invention, a different number of upper stationary contacts 90 may be utilized.

The center portion 96 of the shield 16 may be bent relative to the shield 16 such that it is deflected toward the header blank 22 to assure positive contact between the center portion 96 of the shield 16 and the header blank 22. This feature ensures proper grounding of the shield 16, and prevents high frequency leakage between the signal paths.

Figure 5:
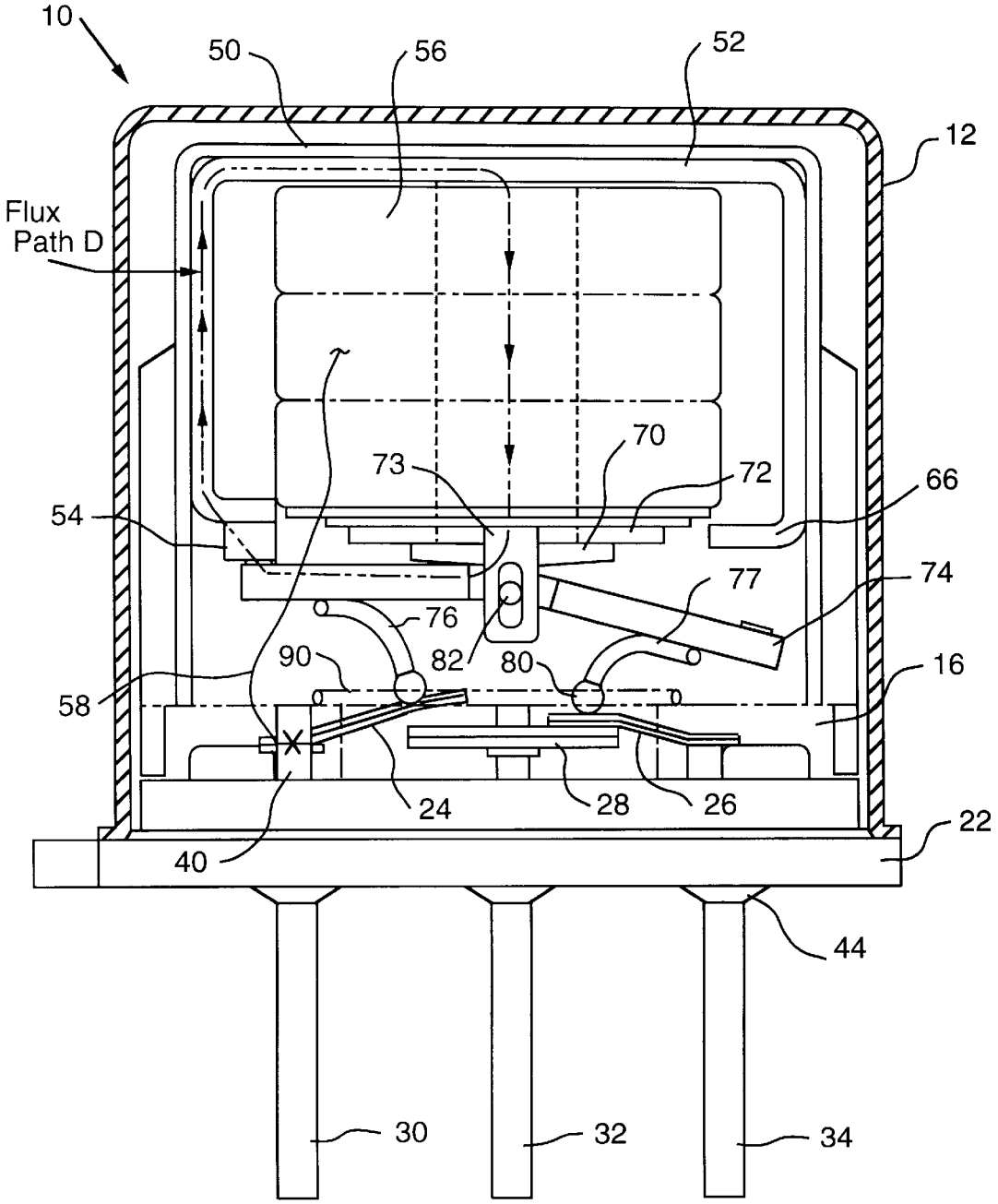
FIG. 5 is diagram illustrating a cross-sectional side-view of the relay of FIG. 1 in the de-energized state.

The operation of the relay 10 is now described with reference to FIGS. 5–8. When no voltage is applied across the voltage terminals 36, 38, no electrical current flows through the coil 56. This corresponds to the de-energized state of the relay 10. FIG. 5 is a cross-sectional side-view of the relay 10 of FIG. 1 in the de-energized state. In the de-energized state, the permanent magnet 54 retains the armature in the de-energized position by virtue of the attractive force of magnetic flux path D from the permanent magnet 54. In other embodiments of the present invention, the armature 74 may be retained in the de-energized position by a biasing spring, such as a leaf spring. With the armature 74 in the de-energized position, the insulative head 80 of the actuator 77 is forced against the NC moving contact 26, and is disposed in the channel 86 of the cavity 84, such that the NC moving contact 26 is forced against the lower stationary contact 28. Still in the de-energized position, the actuator 76 is not forced against the NO moving contact 24, which is disposed in the channel 85, allowing the NO moving contact 24 to be forced against the end 91 of the upper stationary contact 90 by virtue of the mechanical spring action of the NO moving contact 24.

Figure 6:
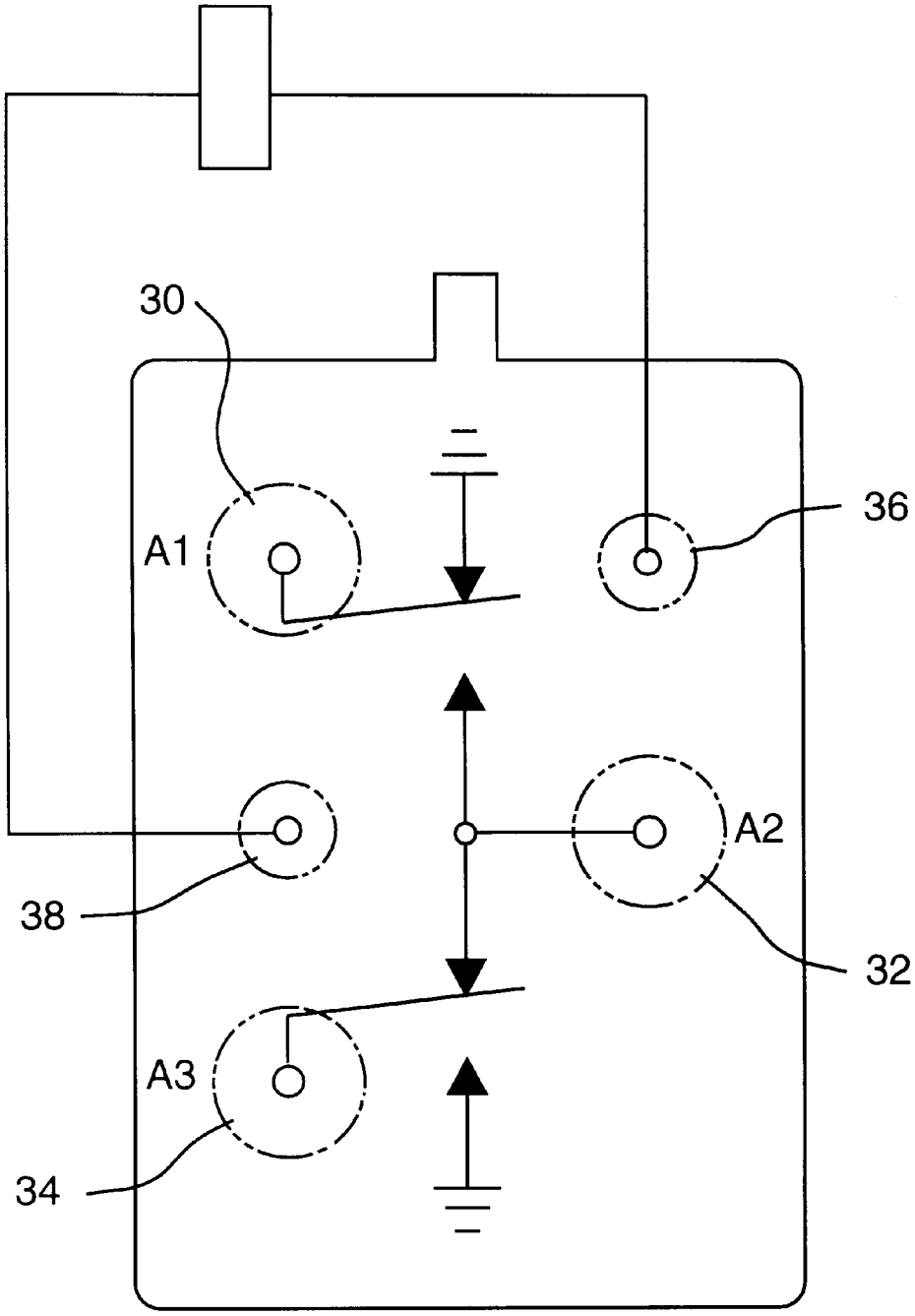
FIG. 6 is a diagram modeling equivalent electrical circuit connections between the signal and voltage terminals of the relay of FIG. 1 in the de-energized state.

FIG. 6 is a diagram modeling equivalent electrical circuit connections of the relay 10 in the de-energized state. In the de-energized state, because the NC moving contact 26 is connected to the signal terminal 34 (A3) and because the lower stationary contact 28 is connected to the signal terminal 32 (A2), a signal path is created between the signal terminal 32 (A2) and the signal terminal 34 (A3). In addition, because the upper stationary contact 90 is connected to electrical ground (via the shield 16 and the header blank 22), and because the NO moving contact 24 is connected to the signal terminal 30 (A1), a signal path is created between the signal terminal 30 (A1) and electrical ground. In the de-energized state, i.e., when there is no voltage across the voltage terminals 36, 38, the signal terminal 30 (A1) is connected to electrical ground and the signal terminal 32 (A2) is connected to signal terminal 34 (A3).

Figure 7:
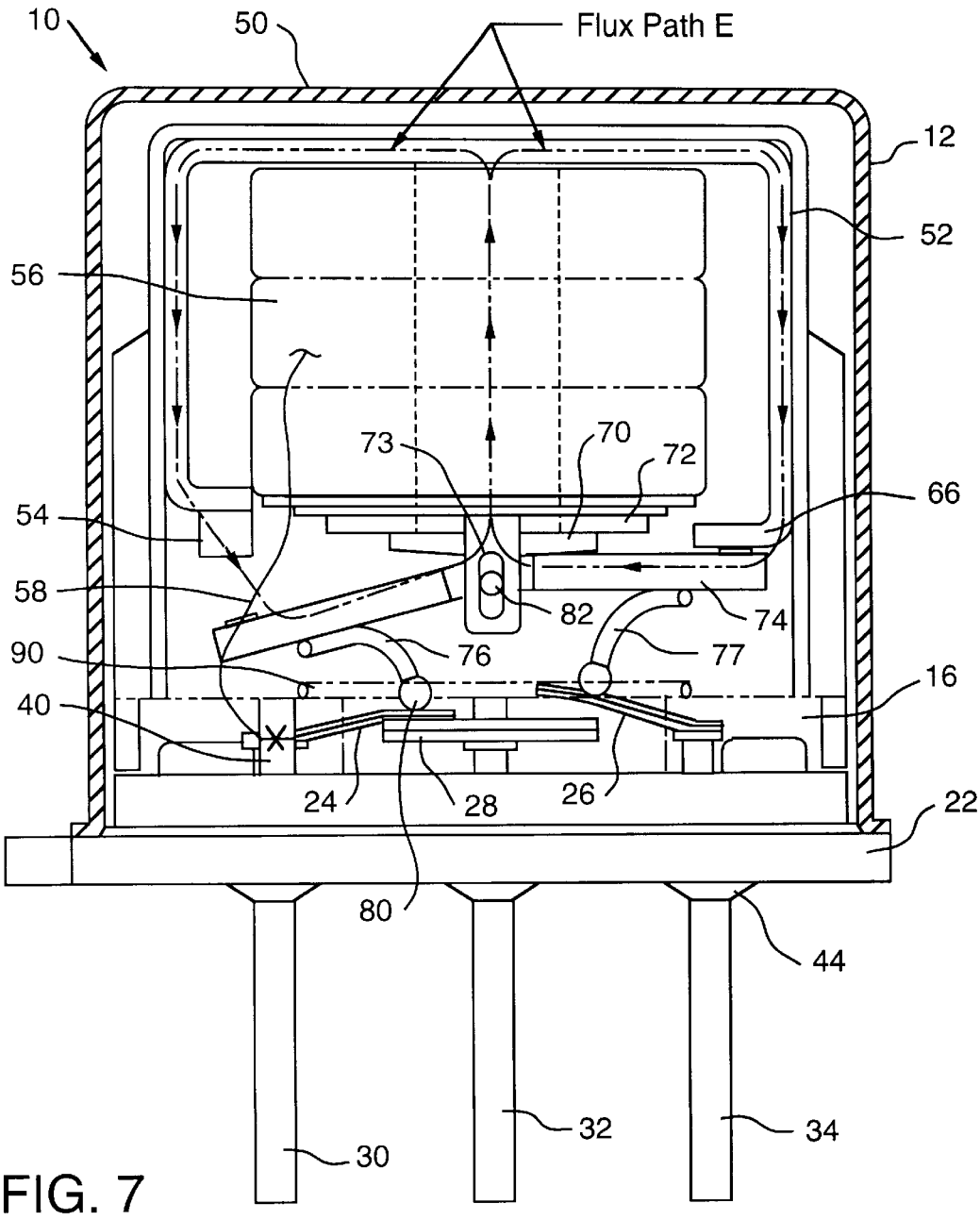
FIG. 7 is a diagram illustrating a cross-sectional side-view of the relay of FIG. 1 in the energized state.
Figure 8:
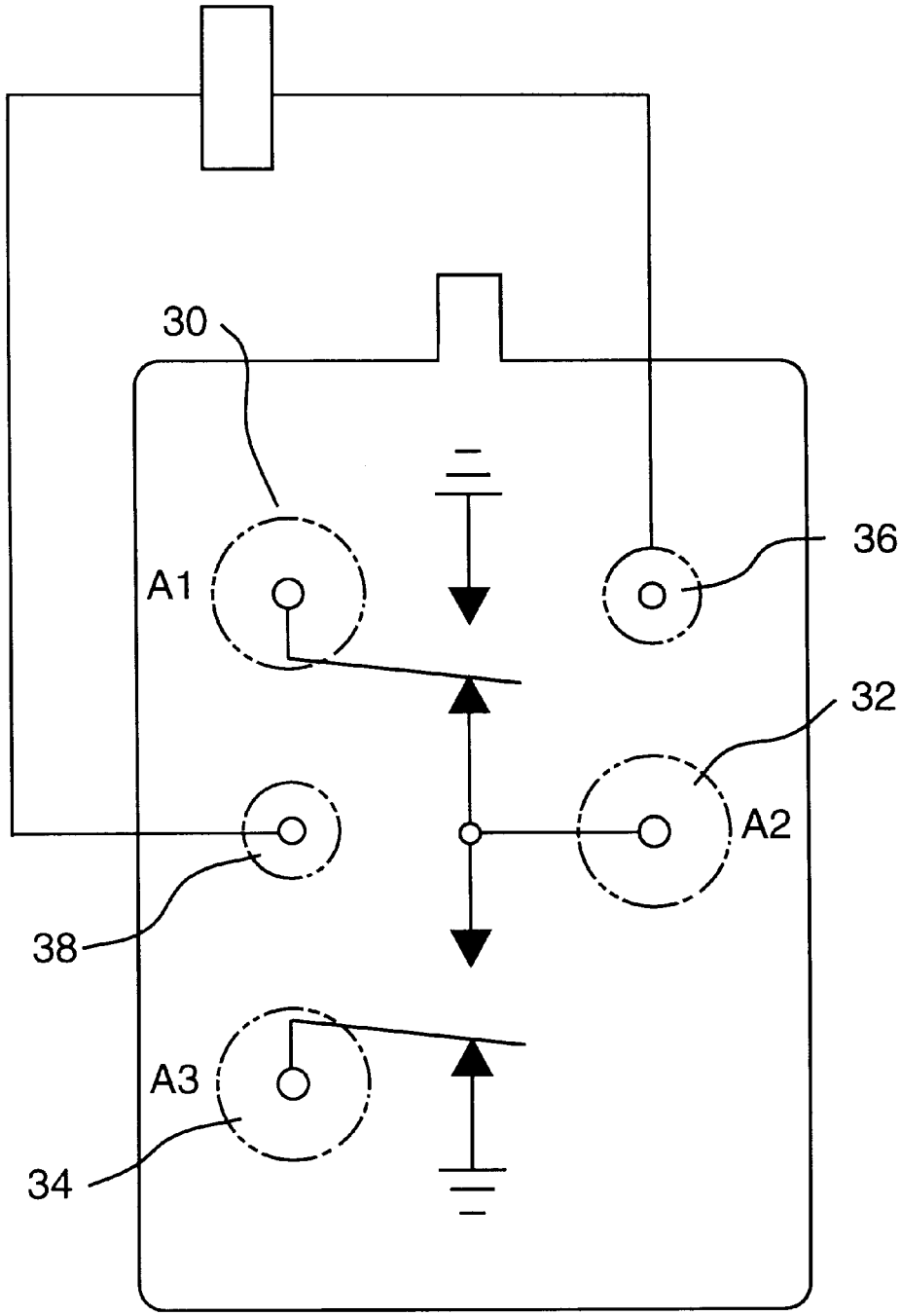
FIG. 8 is a diagram modeling equivalent electrical circuit connections between the signal and voltage terminals of the relay of FIG. 1 in the energized state.

When a voltage is applied across the voltage terminals 36, 38 electrical current flows in the coil 56. This corresponds to the energized state of the relay 10. FIG. 7 is a cross-sectional view of the relay 10 in the energized state. The current in the coil 56 induces a magnetic flux in flux path E which is in a direction opposite to flux path D. As the current in the coil 56 increases, the holding force of the armature 74 against the permanent magnet 54 decreases by virtue of the decreasing net magnetic flux. The mechanical force of the NC moving contact 26 against the actuator 77 in conjunction with the electromagnetic attractive force between the armature 74 and the pole face 66 of the frame 52 from flux path E eventually creates a net torque in the counter-clockwise (CCW) direction, relative to FIG. 7, causing the armature 74 to rotate in the CCW direction into the energized position. With the armature 74 in the energized position, the head 80 of the actuator 76 forces the NO moving contact 24 against the lower stationary contact 28, thus creating a signal path between the signal terminal 30 (A1) and the signal terminal 32 (A2). With the armature 74 still in the energized state, the other actuator 77 is not forced against the NC moving contact 26, allowing the NC moving contact 26 to be forced against the end 92 of the upper stationary contact 90 by virtue of the mechanical spring action of the NC moving contact 26. Thus, a signal path is created between the signal terminal 34 (A3) and electrical ground. This is illustrated in FIG. 8, which models equivalent electrical circuit connections of the relay 10 in the energized state.

When the voltage is removed from the voltage terminals 36, 38, current stops flowing through the coil 56, which eventually reduces the magnetic flux of flux path E to substantially zero. With no induced flux in flux path E, there is minimal attractive force between the armature 74 and the pole face 66 of the frame 52. The mechanical force of the NO moving contact 24 against the actuator 76 in conjunction with the electromagnetic attractive force between the armature 74 and the permanent magnet 54 creates a net torque in the clockwise (CW) direction, relative to FIG. 7, causing the armature 74 to rotate in the CW direction into the de-energized position. With the armature in the de-energized position, the signal terminal 32 (A2) is connected to the signal terminal 34 (A3), and the signal terminal 30 (A1) is connected to ground, as described hereinbefore.

Figure 9:
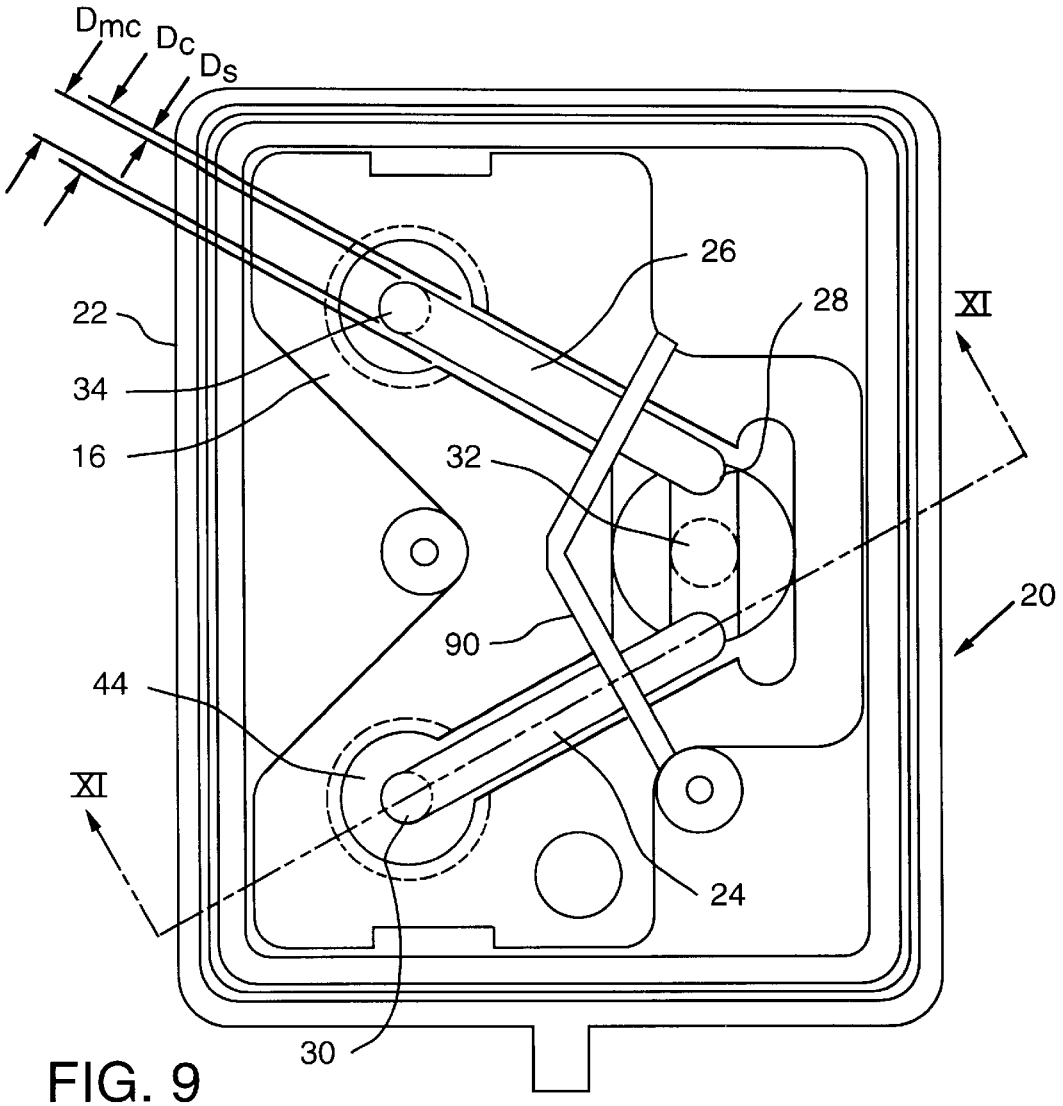
FIG. 9 is a diagram illustrating a top-view of the shield and header assembly of the relay of FIG. 1.
Figure 10:
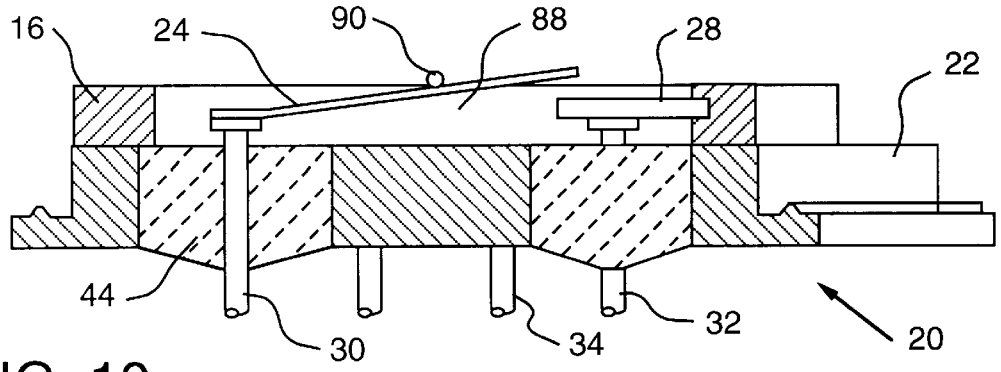
FIG. 10 is a diagram illustrating a cross-sectional side-view of the shield and header assembly of the relay of FIG. 1.

FIGS. 9 and 10 are diagrams illustrating the shield 16 and the header assembly 20 of the relay 10 of FIG. 1. FIG. 9 is a top view of the shield 16 and the header assembly 20 and FIG. 10 is a cross-sectional side-view of the shield 16 and the header assembly 20. Signal fidelity is achieved by matching the impedance of the signal path along the contacts 24, 26, 28 with that of the signal source. Impedance matching of the signal path through the contacts 24, 26, 28 is achieved where the edges of the contacts 24, 26, 28 are in close proximity to the side walls 88 of the shield 16 such that the contacts 24, 26, 28 are strongly coupled to the shield 16. The separation distance, denoted as $D_S$, between the edges of the moving contacts 24, 26 and the side walls 88 of the shield 16 characterizes the impedance of the signal path through the moving contacts 24, 26. Because both the contacts 24, 26, 28 and the shield 16 are made of electrically conductive materials, the signal transmitting through the relay 10 is capacitively coupled between the contacts 24, 26, 28 and the shield 16. The degree of signal coupling is a function of the signal frequency and the capacitance between the contacts 24, 26, 28 and the shield 16. The amount of capacitance between the contacts 24, 26, 28 and the shield 16 is a function of their separation distance, the thickness of the contacts 24, 26, 28, and the thickness of the shield 16. Thus, the impedance of the signal path may be varied by varying the separation distance, $D_S$, between the moving contacts 24, 26 and the side walls 88 of the shield 16. In other words, the impedance may be represented by a ratio aspect relationship between the width of the moving contacts 24, 26, denoted by $D_{MC}$, and the width of the channels 85, 86 of the cavity 84, denoted by $D_C$, in which the moving contacts 24, 26 are disposed. Experimental and numerical modeling has shown that when this ratio ($D_{MC}/D_C$) approaches 0.84, the impedance of the signal path is approximately 50Ω, a system impedance widely used in high frequency applications. Reducing the ratio, which corresponds to a greater separation distance, $D_S$, between the moving contacts 24, 26 and the shield 16, results in a greater signal path impedance, although the relationship is non-linear. Because the contacts 24, 26, 28 are in close proximity to the side walls 88 of the shield 16, the coupling between the contacts 24, 26, 28 and the shield 16 is greater than the coupling between the contacts 24, 26, 28 and other ground sources, such as the armature 74 and the header blank 22. Accordingly, the side walls 88 function as a protective barrier against leakage and radiation of high frequency signals transmitting through the relay 10.

Signal fidelity may also be enhanced by matching the impedance of the signal path through the signal terminals 30, 32, 34 with that of the signal source. Impedance matching of the signal terminals 30, 32, 34 is achieved by proper sizing of the seals 44 with respect to the diameter of the signal terminals 30, 32, 34 and the dielectric constant of the insulative material of which the seals 44 are made, as described hereinbefore. It should be noted that the sizing of the seals 44 insulating the voltage terminals 36, 38 from the header blank 22 have a negligible affect on signal fidelity.

Figure 11:
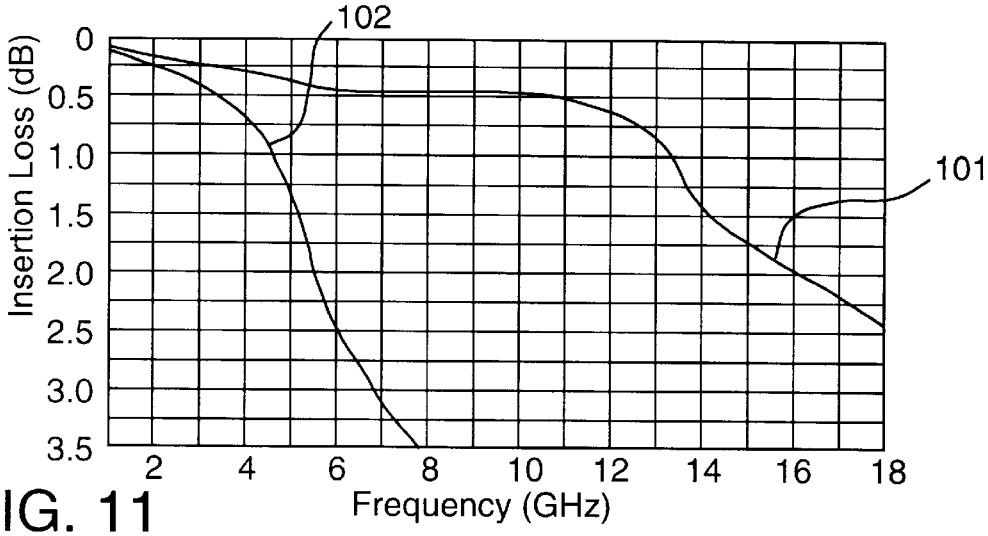
FIG. 11 is a graph of the insertion loss of a relay constructed according to the teachings of the present invention and the combined best data of Teledyne Relays RF 100 Series and the Teledyne Relays RF 300 Series relays.
Figure 12:
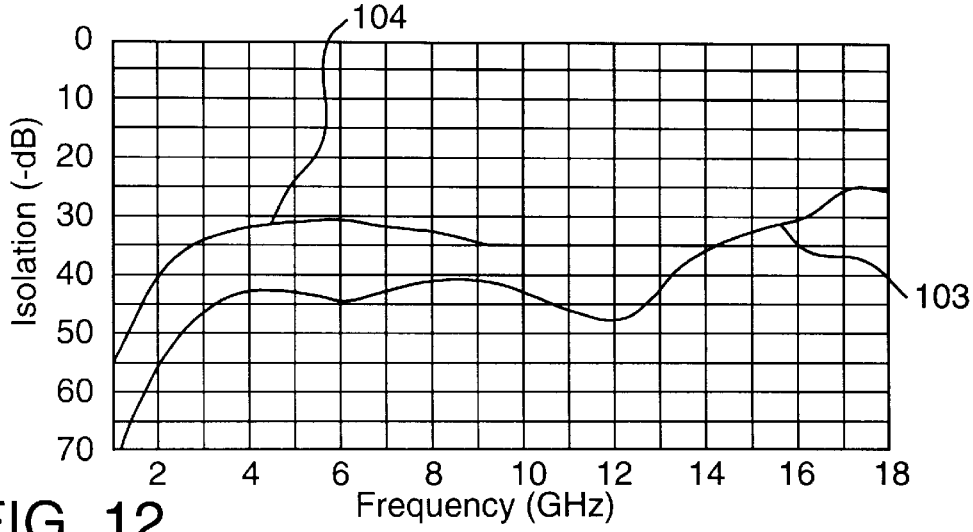
FIG. 12 is a graph of the isolation loss of a relay constructed according to the teachings of the present invention and combined best data of Teledyne Relays RF 100 Series and the Teledyne Relays RF 300 Series relays.
Figure 13:
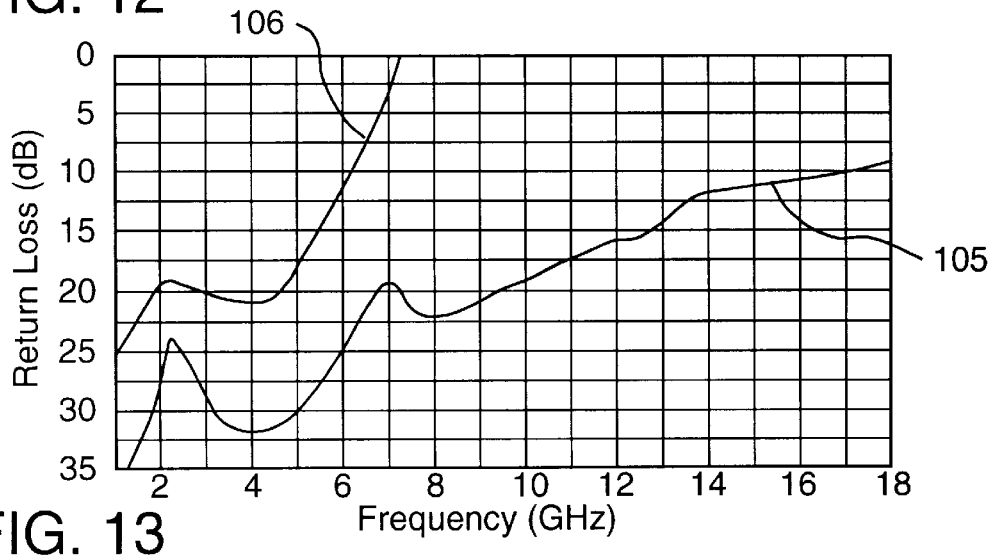
FIG. 13 is a graph of the return loss of a relay constructed according to the teachings of the present invention and combined best data of Teledyne Relays RF 100 Series and the Teledyne Relays RF 300 Series relays.

The superior RF characteristics of the relay 10 according to the present invention are depicted graphically in FIGS. 11–13. FIGS. 11–13 show the frequency response for three key RF parameters for the relay 10 of the present invention and for the combined best data of two relays from the relevant art, the Teledyne Relays RF 100 Series and the Teledyne Relays RF 300 Series. FIG. 11 is a graph of the insertion loss of the relay 10 of the present invention and the relevant art relays. The insertion loss as a function of frequency of the relay 10 of the present invention is illustrated in FIG. 11 as 101. The combined best insertion loss of the Teledyne Relays RF 100 Series and the Teledyne Relays RF 300 Series relays is illustrated in FIG. 11 as 102. The typical insertion loss limit for an RF relay is 1.0 dB. Any relay with insertion loss exceeding 1.0 dB is considered impractical to use. The relay 10 of the present invention has an insertion loss of less than 1.0 dB up to approximately 13.0 GHz, while the relevant art relays have an insertion loss less than 1.0 dB only up to approximately 4.2 GHz.

FIG. 12 is a graph of the isolation loss of the relay 10 constructed according to the teachings of the present invention and the relevant art relays. The isolation loss as a function of the frequency of the relay 10 of the present invention is illustrated in FIG. 12 as 103. The combined best insertion loss of the Teledyne Relays RF 100 Series and the Teledyne Relays RF 300 Series relays is illustrated in FIG. 12 as 104. For high frequency applications, the isolation loss is typically required to be 40 dB or greater. The relay 10 of the present invention exhibits better than 40 dB isolation loss up to 13 GHz, while the relevant art relays only provide 40 dB or better isolation loss up to 2 GHz.

FIG. 13 is a graph of the return loss of the relay 10 constructed according to the teachings of the present invention and the relevant art relays. The return loss as a function of frequency of the relay 10 of the present invention is illustrated in FIG. 13 as 105. The best combined return loss of the Teledyne Relays RF 100 Series and the Teledyne Relays RF 300 Series relays is illustrated in FIG. 13 as 106. The return loss of an RF relay is typically required to be 15 db or higher. The relay 10 of the present invention exhibits a return loss better than 15 dB up to approximately 12 GHz, while the prior art relays exhibit a return loss better than 15 dB only up to 5 GHz.

The present invention is also directed to a method of matching the impedance of the relay 10 with the impedance of a signal source. The method includes disposing a number of contacts 24, 26, 28 of the relay 10 in the cavity 84 of the shield 16, such that the edges of the contacts 24, 26, 28 are in close proximity to the side walls 88 of the shield 16, such that the contacts 24, 26, 28 are strongly coupled to the shield 16 and weakly coupled to other ground sources, such as the armature 74 and header blank 22.

Those of ordinary skill in the art will recognize that many modifications and variations of the present invention may be implemented. The foregoing description and the following claims are intended to cover all such modifications and variations. Furthermore, the materials and processes disclosed are illustrative, but are not exhaustive. Other materials and processes may also be used to make devices embodying the present invention.

What is claimed is:

1. A relay comprising:

a frame;

a header assembly having a first plurality of contacts, wherein said first plurality of contacts include a plurality of moving contacts and at least one lower stations contact;

a core assembly having an end engaging said fame;

an armature assembly pivotally connected to said core assembly, said armature assembly having an armature and at least one actuator engaging one of said contacts;

a shield connected to said header assembly, said shield defining a cavity in which said first plurality of contacts are disposed; and at least one upper stationary contact connected to said shield, wherein one of said moving contacts engages said lower stationary contact and one of said moving contacts engages said upper stationary contact when the relay is in a de-energized state.

2. The relay of claim 1, wherein said shield has a center portion, said center portion bent relative to said shield, and said center portion connected to said header assembly.

3. The relay of claim 2, wherein said upper stationary contact is connected to said center portion of said shield.

4. The relay of claim 1, wherein said upper stationary contact includes a plurality of ends.

5. The relay of claim 4, wherein said upper stationary contact is V-shaped.

6. The relay of claim 4, wherein said cavity includes a plurality of channels.

7. The relay of claim 6, wherein at least one of said ends of said upper stationary contact is adjacent one of said channels of said cavity.

8. The relay of claim 6, wherein each of said ends of said upper stationary contact is adjacent one of said channels of said cavity.

9. The relay of claim 1, wherein said cavity includes a plurality of channels.

10. The relay of claim 1, wherein said cavity is V-shaped.

11. The relay of claim 1, wherein said cavity is sized such that the electrical coupling between said contacts and said shield is greater than the electrical coupling between said contacts and said armature.

12. The relay of claim 1, wherein said cavity is sized such that the electrical coupling between said contacts and said shield is greater than the electrical coupling between said contacts and said header assembly.

13. The relay of claim 1, wherein said header assembly includes a header blank, wherein said first plurality of contacts are insulatively connected to said header blank.

14. The relay of claim 13, wherein said cavity is sized such that the electrical coupling between said first plurality of contacts and said shield is greater than the electrical coupling between said first plurality of contacts and said header blank.

15. The relay of claim 13, further comprising a plurality of signal terminals connected to said fist plurality of contacts.

16. The relay of claim 15, further comprising a plurality of seals between said terminals and said header blank.

17. The relay of claim 1, further comprising at least one hinge pin connecting said armature assembly to said core assembly.

18. The relay of claim 1, wherein said shield includes an electrically conductive material.

19. The relay of claim 1, wherein one of said moving contacts engages said lower stationary contact and one of said moving contacts engages said upper stationary contact when the relay is in an energized state.

20. A relay comprising:

a frame:

a header assembly have a header blank, said header blank insulatively connected to a plurality of moving contacts and at least one lower stationary contact;

a care assembly having an end engaging said frame;

a shield connected to said header blank, said shield defining a cavity in which said moving contacts and said lower stationary contact are disposed;

at least one upper stationary contact connected to said shield; and an armature assembly pivotally connected to said core assembly, said armature assembly having an armature and a plurality of actuators, at least one of said actuators engaging one of said moving contacts, wherein at least one of said moving contacts engages said lower stationary contact and at least one of said moving contacts engages said upper stationary contact when the relay is in a de-energized state.

21. The relay of claim 20, wherein at least one of said moving contacts engages said lower stationary contact, and at least one of said moving contacts engages said upper stationary contact when the relay is in an energized state.

22. The relay of claim 20, wherein:

said cavity includes a plurality of channels in which said moving contacts are disposed; and said upper stationary contact includes a plurality of ends, each of said ends adjacent to one of said channels.

23. The relay of claim 20, wherein said shield includes an electrically conductive material.

24. A relay comprising:

a frame;

a header assembly having a first plurality of contacts, wherein said first plurality of contacts include a plurality of moving contacts and at least one lower stationary contact;

a core assembly having an end engaging said frame;

an armature assembly pivotally connected to said core assembly, said armature assembly having an armature and at least one actuator engaging one of said contacts;

a shield connected to said header assembly, said shield defining a cavity in which said plurality of contacts are disposed; and at least one upper stationary contact connected to said shield, wherein one of said moving contacts engages said lower stationary contact, and one of said moving contacts engages said upper stationary contact when the relay is in an energized state.

25. A relay comprising;

a frame;

a header assembly having a header blank, said header blank insulatively connected to a plurality of moving contacts and at least one lower stationary contact;

a core assembly having an end engaging said frame;

a shield connected to said header blank, said shield defining a cavity in which said moving contacts and said lower stationary contact are disposed;

at least one upper stationary contact connected to said shield; and an armature assembly pivotally connected to said core assembly, said armature assembly having an armature and a plurality of actuators, at least one of said actuators engaging one of said moving contacts, wherein at least one of said moving contacts engages said lower stationary contact, and at least one of said moving contacts engages said upper stationary contact when the relay is in an energized state.

* * * * *